United States Patent [19]

Harvey

[11] Patent Number: 4,681,312

[45] Date of Patent: Jul. 21, 1987

[54] SHEET STACKER

[75] Inventor: Raymond A. Harvey, St. Albans, England

[73] Assignee: Xerox Corporation, Stamford, Conn.

[21] Appl. No.: 854,365

[22] Filed: Apr. 21, 1986

[30] Foreign Application Priority Data

Apr. 23, 1985 [GB] United Kingdom ..... 8510274

[51] Int. Cl.[4] ..... B65H 31/02; B65H 31/34

[52] U.S. Cl. ..... 271/207; 271/286; 414/35; 414/103

[58] Field of Search ..... 271/207, 285, 286, 184, 271/185, 213; 414/103, 35

[56] References Cited

U.S. PATENT DOCUMENTS

| | | | |
|---|---|---|---|
| 1,228,750 | 6/1917 | Crittenden | 271/213 |
| 2,770,192 | 11/1956 | Mitchell et al. | 271/207 X |
| 3,829,083 | 8/1974 | Shiina et al. | 271/207 X |
| 3,946,879 | 3/1976 | Jensen | 271/185 X |
| 4,135,804 | 1/1979 | Schoppe et al. | 355/3 SH |
| 4,335,954 | 6/1982 | Phelps | 355/14 SH |
| 4,417,801 | 11/1983 | Eisemann | 355/3 SH |
| 4,447,167 | 5/1984 | Euteneuer et al. | 271/207 X |
| 4,480,825 | 11/1984 | Landa | 271/207 X |
| 4,487,407 | 12/1984 | Baldwin | 271/233 |
| 4,548,393 | 10/1985 | Irvine et al. | 270/59 |
| 4,605,211 | 8/1986 | Sonobe | 271/207 X |

FOREIGN PATENT DOCUMENTS

| | | |
|---|---|---|
| 0099248 | 1/1984 | European Pat. Off. . |
| 5548184 | 9/1978 | Japan . |

*Primary Examiner*—Joseph J. Rolla
*Assistant Examiner*—Frederick R. Handren
*Attorney, Agent, or Firm*—William A. Henry, II

[57] ABSTRACT

A sheet stacker, e.g. for a photocopier, providing accurate trail edge registration includes co-acting driven output rollers associated with a sheet guide for directing sheets in an upwardly inclined direction. An output tray for receiving sheets exiting the output rollers has a support face inclined upwardly in the direction of sheet travel at an angle greater than that imparted to the approaching sheets such that the leading edges of the sheet contact the support face before the trail edges exit the output rollers. The output tray also includes a base edge support which, in the plane of the support face, is inclined downwardly and comprises at the lower end a corner registration stop. A fulcrum is provided at the upper end of the base edge support and is arranged such that after exiting the output rollers the sheets slide under their own weight, trail edge first, down the support face and abut the fulcrum intermediate their edges remote from the registration corner stop and the center of the sheets. Thus the sheets rotate under their own weight about the fulcrum until their trail edges abut the base edge support, the inclination of which is such that the sheets slide on their trail edges down the support until they abut the corner registration stop.

9 Claims, 2 Drawing Figures

SHEET STACKER

Figure 1:
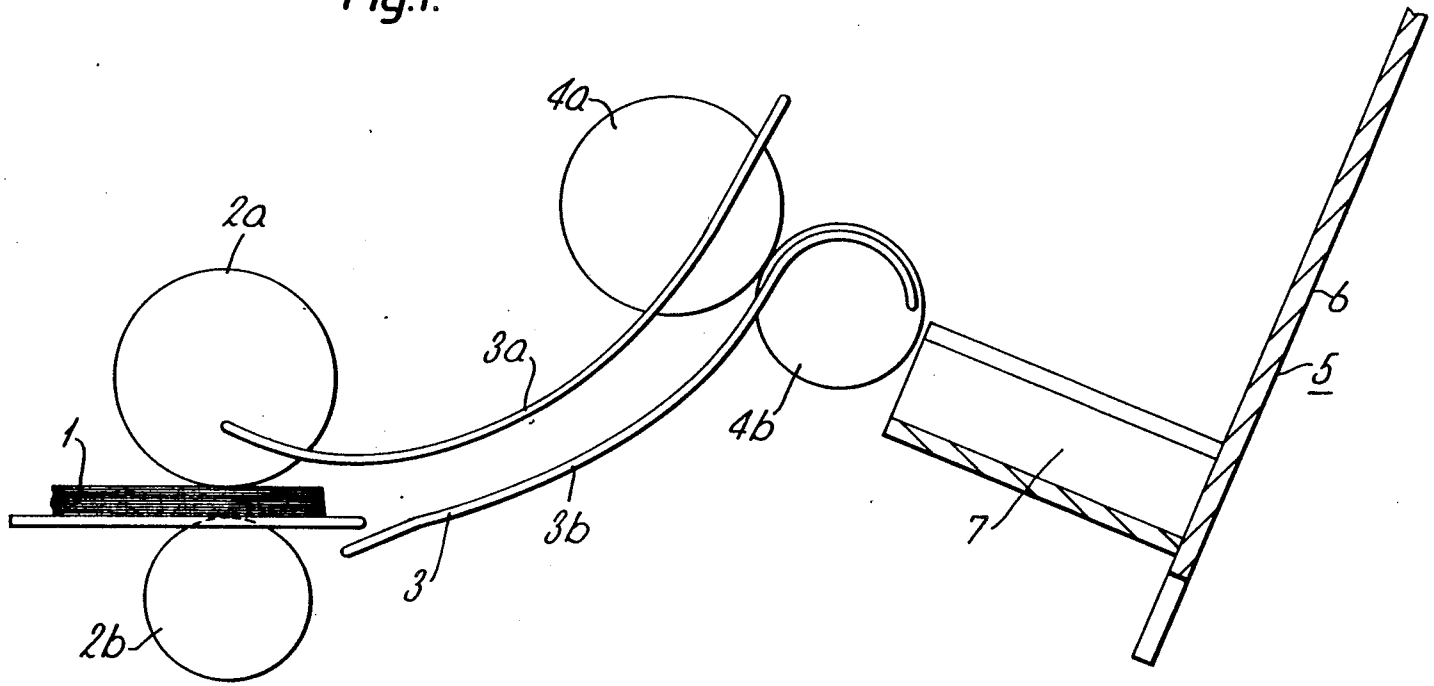

This invention relates to sheet stackers and particularly to those in which sheets are collected on a support surface against a registration stop.

Sheet stackers are used in many situations where sheets are fed out for collection, for example in printing, photocopying or duplicating machines.

In order to register sheets entering the stacker, they are generally fed against a registration stop. Conventional stackers use so called "lead edge registration" where the registration stop is provided in the path of the sheets entering the stacker so that the lead edge abuts the registration stop when it enters the stacker and brings the sheet to rest. However, a problem with lead edge registration is that sheets ejected into the stacker with too much energy will either bounce back from the registration stop impairing registration, or else the sheets may even be damaged by impact with the registration stop. On the other hand sheets ejected into the stacker with too little energy will fall short of the registration stop, again resulting in misregistration. It is a problem to choose the best location for the registration stop to achieve optimum registration particularly when sheets of different sizes and weights are to be used.

In order to reduce the tendency of sheets to bounce back from the registration stop it is known to retard the sheets as they enter the stacker using, for example, plastic fingers which lie on the top of the stack. These, however, tend to provide resistance against sheet motion in forward as well as the reverse direction and although this can help to prevent damage when sheets are ejected with too much energy it can also impede sheets with insufficient energy so they stop short of the registration stop.

No. EP-A-0 099 248 discloses a lead edge registration stacker in which damping means are provided in the form of a roller which contacts the upper surface of a sheet being stacked and is rotatable only in the direction corresponding to movement of a sheet towards the registration stop. Because the roller is able to rotate in the forward direction of the sheet it provided little resistance, but by being prevented from rotating in the opposite direction it positively inhibits the reverse motion of the sheet. Unfortunately however, this stacker still suffers from the disadvantage that sheets ejected with too much energy can be damaged on impact with the registration stop.

An alternative approach is to use so called "trail edge registration" in which the sheets are fed in an upwardly inclined direction into an upwardly inclined output tray so that the sheets are retarded by gravity and frictional forces rather than by mechanical means. When zero upward velocity is reached the sheets then slide under their own weight down the output tray, trail edge first, until they abut a registration stop at the lower end of the output tray below the level at which the sheets are ejected. This approach has the advantage that the output velocity, typically in the range of 75 to 150 cm/sec. is reduced considerably before the trail edges of the sheets contact the registration stop, thus avoiding the problem of sheets bouncing back and minimising the risk of damage. Also the output tray is inclined sufficiently steeply that all sheets slide down the registration stop under their own weight regardless of the velocity with which they were ejected into the output tray.

Moreover trail edge registration is effective over a wide range of sheet sizes and weights.

Japanese Utility Model No. 55-48184 (Application No. 53-132075) laid-open on Mar. 29, 1980 discloses a sheet stacker comprising co-acting driven output rollers associated with means for directing sheets in an upwardly inclined direction, and an output tray for receiving sheets exiting the output rollers. The output tray comprises a support face inclined upwardly in the direction of sheet travel at an angle greater than that imparted to sheets by the output means such that the leading edges of the sheets contact the support face before the trail edges exit the output rollers. This arrangement helps to prevent sheet damage as the sheets enter the output tray. The output tray further comprises base edge support means arranged so that after exiting the output rollers the sheets slide under their own weight, trail edge first, down the support face of the output tray until they abut the base edge support means.

While this trail edge registration stacker has all the advantages mentioned above, it does not suggest any means of registering the sheets transversely to the direction of sheet ejection.

According to the present invention there is provided a sheet stacker comprising co-acting driven output rollers associated with means for directing sheets in an upwardly inclined direction, and an output tray for receiving sheets exiting the output rollers, said output tray comprising a support face inclined upwardly in the direction of sheet travel at an angle greater than that imparted to sheets by the output means such that the leading edges of the sheets contact the support face before the trail edges exit the output rollers, the output tray further comprising base edge support means arranged such that after exiting the output rollers the sheets slide under their own weight trail edge first down the support face of the output tray until they abut said base edge support means, characterised in that the base edge support means in the plane of the support face is arranged in a downwardly inclined direction and comprises at the lower end thereof a corner registration stop, and in that a fulcrum is provided at the upper end of the base edge support means, the fulcrum being arranged such that when the sheets slide down the support face their trail edges abut the fulcrum intermediate their edges remote from the registration corner stop and the centre of the sheet, whereby the sheets rotate under their own weight about said fulcrum until their trail edges abut the base edge support means, the inclination of the base edge support means being such that the sheets slide on their trail edges down the base edge support means until the edges of the sheets facing the corner registration stop abut said stop.

A stacker in accordance with the invention is a trail edge registration system and has not only the advantages generally associated with such systems as discussed above, but also has the further benefit of registering the sheets in the direction transverse to the direction in which the sheets are travelling when they enter the output tray.

The base edge support means of the output tray may comprise first and second downwardly extending portions with respective first and second corner registration stops, the second portion in the plane of the support face extending from the first portion. This arrangement enables sheets to be stacked against either of the two corner registration stops, thus offering a set off-setting facility. In addition, means may be provided for oscillating the support face so that predetermined numbers of sheets register alternately with the first and second corner registration stops.

For increased versatility it is preferable for one of the output rollers to be relatively rigid and the other output roller to be relatively resilient. The stacker can then accommodate separate sheets or sets of sheets (in which the individual sheets may or may not be fastened together) having different thicknesses.

Figure 2:
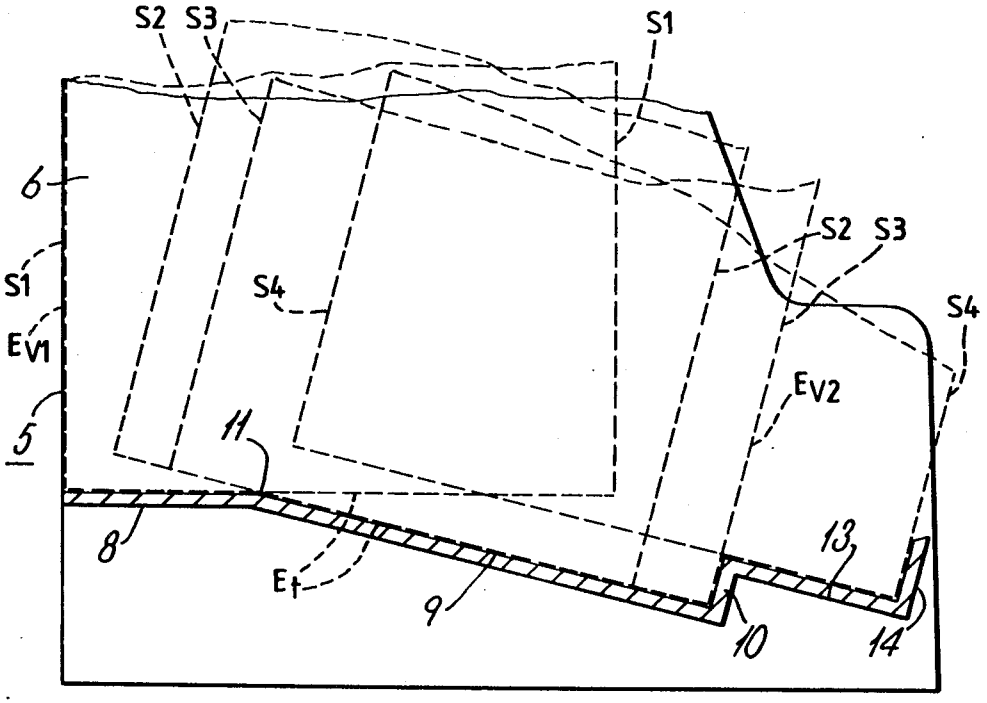

An embodiment of the invention will now be described, by way of example, with reference to the accompanying drawing in which FIG. 1 is a schematic cross-sectional view of a sheet stacker in accordance with the invention and FIG. 2 is a front elevation showing detail of a part of the output tray of the sheet stacker in FIG. 1.

The sheet stacker shown in FIG. 1 is arranged to receive a sheet 1, or indeed a stack of sheets, exiting a photocopier or like machine. The sheet 1 enters the sheet guide 3 of the stacker through nip rollers 2*a*, 2*b* which serve to drive sheets into the stacker. The nip rollers 2*a*, 2*b* may form part of the stacker itself or they may be the exit rolls of that part of the machine in which the sheets are processed.

The sheet guide 3 comprises upper and lower upwardly inclined curvilinear guide members 3*a* and 3*b*. At its lower end the guide 3 is flared to facilitate receiving the sheets fed from the nip rollers 2*a*, 2*b*. At the upper end of the guide 3 two further nip rolls 4*a*, 4*b* receive the leading edge of sheet 1 before the trail edge exits nip rolls 2*a*, 2*b*. The nip rolls 4*a*, 4*b* are driven to advance the sheet typically at about 75 to 150 cm/sec. towards the output tray 5.

The output tray 5 comprises an upwardly inclined support face 6 and a base edge support member 7. The support face 6 is arranged to be more steeply inclined than the approaching sheet 1 so that the leading edge of the sheet 1 contacts the support face 6 before the trail edge exits the rolls 4*a*, 4*b*.

To this end the difference in inclination between the support face and the approaching sheet 1 should be at least 5°. However, this difference in inclination should preferably not exceed 20° otherwise the leading edge tends to stub against the support face 6 resulting in the sheet becoming damaged and impeding the smooth passage of sheets into the output tray 5. In practice, it has been found preferable to arrange the guide 3 and the rolls 4*a*, 4*b* so that the angle of elevation imparted to the sheet 1 is at least 17° and at most 50°, while the support face is arranged to have an angle of elevation of at least 20° and at most 52°. For example if the angle of elevation imparted to the sheet 1 is 37°, the support face 6 can suitably be inclined at 45° to the horizontal.

Thus, when the sheet 1 is ejected from the rolls 4*a*, 4*b* it is received on support face 6 of the output tray 5 and contines to move upwards sliding on the support face 6 retarded solely by natural forces, in particular gravity, but also including frictional and electrostatic forces from the support face 6 or from sheets already stacked in the output tray. In any case the sheet 1 eventually comes to rest on the upwardly inclined support face 6 as its kinetic energy is removed and then the sheet slides under its own weight, trail edge first, down the support face 6 until it abuts the base edge support means 7. The sheet in this position is represented by the broken line S1 in FIG. 2.

As can be seen more clearly in FIG. 2, the base edge support means comprises a relatively short horizontal portion 8 integral with a downwardly inclined portion 9 having a corner registration stop 10. Taken in the plane of the support face 6, it is preferable for the angle of depression of portion 9 to be at least 17° and at most 32°. When the base support 6 is inclined at 45° above the horizontal as mentioned above the base edge portion 9 is suitably inclined at 20° below the horizontal. The inclined portion 9 meets the horizontal portion 8 to provide a fulcrum 11. The relative length of the portions 8 and 9 are chosen such that when the sheet 1 slides down the support face 6 its trailing edge $E_t$ abuts the fulcrum 11 intermediate edge $E_{v1}$ remote from registration corners stop 10 and the centre of the sheet 1. In this way the centre of gravity of the sheet overhangs the inclined portion 9 of the base edge support so that the sheet rotates under its own weight about fulcrum 11 until the trail edge $E_t$ abuts the base support portion 9. The sheet in this position is represented by broken line S2. Thereafter the sheet 1 slides down the inclined portion 9 into position S3 where the edge $E_{v2}$ of the sheet facing the corner registration stop 10 abuts the stop at which point the sheet is brought to rest in registration with sheets previously stacked in the same manner.

As shown in FIG. 2 the base edge support also comprises a second downwardly inclined portion 13 extending from the corner registration stop 10 and having its own corner registration stop 14. By shifting the output tray laterally (to the left as shown in FIG. 2) the base edge support can be brought into such a position that when the sheet slides down the support face 6 it rotates about fulcrum 11 and abuts base edge portion 13 rather than portion 9. The sheet in question will then be registered against corner stop 14 as represented by the broken line S4 in FIG. 2. Thus a set-off setting facility is provided whereby a first set of sheets can be registered against one corner stop 10 and a second set of sheets can be registered against the second corner stop 14. By shifting the support face back to its former position a third set can be registered against the first corner stop 10 and so on. Preferably, a lateral drive mechanism is provided for oscillating the support face 6 in this manner whereby predetermined numbers of sheets register alternately with the two corner registration stops 10 and 14 respectively.

Finally it is noted that in order to accommodate sheets or sets of sheets having different thicknesses the rolls 4*a* and 4*b* may be made of different materials such that one is relatively rigid while the other is relatively resilient. Thus for example roll 4*a* may be made of solid rubber while roll 4*b* may have a sponge construction to allow the passage of either a single sheet or a stack of sheets in which the individual pages may or may not be fastened together.

What is claimed is:

1. A sheet stacker comprising co-acting driven output rollers associated with means for directing sheets in an upwardly inclined direction, and an output tray for receiving sheets exiting the output rollers, said output tray comprising a support face inclined upwardly in the direction of sheet travel at an angle greater than that imparted to sheets by the output means such that the leading edges of the sheets contact the support face before the trail edges exit the output rollers, the output tray further comprising base edge support means arranged such that after exiting the output rollers the sheets slide under their own weight trail edge first down the support face of the output tray until they abut said base edge support means, characterised in that the base edge support means in the plane of the support face is arranged in a downwardly inclined direction and comprises at the lower end thereof a corner registration stop, and in that a fulcrum is provided at the upper end of the base edge support means, the fulcrum being arranged such that when the sheets slide down the support face their trail edges abut the fulcrum intermediate their edges remote from the registration corner stop and the centre of the sheets, whereby the sheets rotate under their own weight about said fulcrum until their trail edges abut the base edge support means, the inclination of the base edge support means being such that the sheets slide on their trail edges down the base edge support means until the edges of the sheets facing the corner registration stop abut said stop.

2. A sheet stacker as claimed in claim 1, characterised in that the base edge support means of the output tray comprises first and second downwardly extending portions with respective first and second corner registration stops, the second portion in the plane of the support face extending from the first portion.

3. A sheet stacker as claimed in claim 2, characterised in that means are provided for oscillating the support face laterally so that predetermined numbers of sheets register alternately with the first and second corner registration stops.

4. A sheet stacker as claimed in claim 1, characterised in that the angle of inclination of the support face is between about 5° and 20° greater than that imparted to the sheets by the output means.

5. A sheet stacker as claimed in claim 4, characterised in that the angle of elevation of the support face is between about 20° and55°.

6. A sheet stacker as claimed in claim 5, characterised in that the angle of elevation imparted to the sheets by the output means is at least 17° and at most 52°.

7. A sheet stacker as claimed in claim 6, characterised in that the angle of depression of the base edge support means is at least 17° and at most 32°.

8. A sheet stacker as claimed in claim 1, characterised in that the angle of elevation of the support face is at least 45° and at most 48°, and the angle of depression of the base edge support means is approximately 20°.

9. A sheet stacker as claimed on claim 7, characterised in that one output roller is relatively rigid and the other output roller is relatively resilient to accommodate sheets or sets of sheets having different thicknesses.

* * * * *